United States Patent [19]

Jandl et al.

[11] 4,400,598

[45] Aug. 23, 1983

[54] SLIDER SWITCH

[75] Inventors: Erwin Jandl; Josef-Elmar Prang, both of Bietigheim-Bissingen, Fed. Rep. of Germany

[73] Assignee: ITT Industries, Inc., New York, N.Y.

[21] Appl. No.: 183,459

[22] Filed: Sep. 2, 1980

Related U.S. Application Data

[63] Continuation of Ser. No. 20,649, Mar. 15, 1979, abandoned.

[30] Foreign Application Priority Data

Mar. 22, 1978 [DE] Fed. Rep. of Germany ..... 2812423

[51] Int. Cl.[3] ..... H01H 15/00; H01H 9/00

[52] U.S. Cl. ..... 200/16 D; 200/61.54

[58] Field of Search ..... 200/16 C, 16 D, 61.27, 200/61.3, 61.34, 61.35, 4, 61.54

[56] References Cited

U.S. PATENT DOCUMENTS

| | | | |
|---|---|---|---|
| 3,499,125 | 3/1970 | Stoi | 200/4 |
| 3,511,943 | 5/1970 | Kibler | 200/4 |
| 3,665,130 | 5/1972 | Suzuki | 200/61.27 |
| 3,873,790 | 3/1975 | Coons | 200/61.54 X |
| 3,934,101 | 1/1976 | Jones | 200/5 B |
| 3,963,884 | 6/1976 | Pollock | 200/16 D |

FOREIGN PATENT DOCUMENTS

| | | | |
|---|---|---|---|
| 2531696 | 2/1977 | Fed. Rep. of Germany | 200/61.54 |
| 2726351 | 12/1978 | Fed. Rep. of Germany | 200/61.54 |

*Primary Examiner*—J. R. Scott

*Attorney, Agent, or Firm*—James B. Raden; Marvin M. Chaban

[57] ABSTRACT

A slider switch mechanism especially adapted for use on the steering column of an automotive vehicle for use as a speed control mechanism. The switch mechanism uses a slider constrained to translatory motion within guides of an enclosing housing. The slider is first assembled to a support member and the resulting assembly is fitted into and locked to the enclosing housing. The slider bears a compression spring which is held between axially spaced posts of a support member. The support member is fitted into an opening in one end of the housing and is advanced until a resilient locking member snaps into a cutout in the adjacent wall of the housing. When the support member is fully advanced into the housing, mating holders of the support member and housing are joined to lock the slider assembly into the housing. The slider may then be translated as necessary within the housing cavity, as desired.

3 Claims, 13 Drawing Figures

FIG. 7
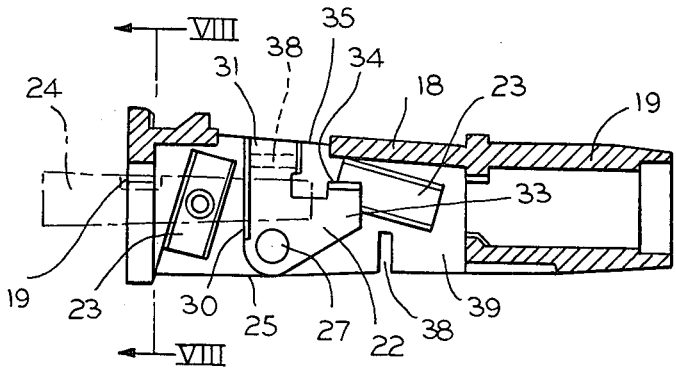
FIG. 8
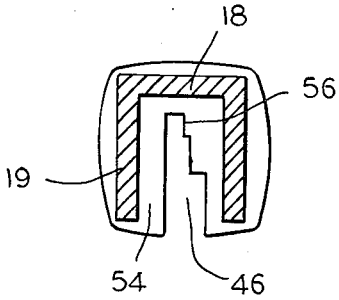
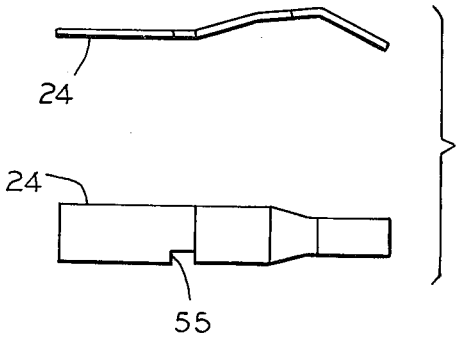
FIG. 9

SLIDER SWITCH

This is a continuation of application Ser. No. 20,649, filed Mar. 15, 1979, now abandoned.

BACKGROUND OF THE INVENTION

An earlier design of a slider switch is shown by German Patent Application No. P 27 26 521.0, filed June 11, 1977, It became obvious in operation of the mechanism of the cited German application that the slider is not always sufficiently secured in its guide, because its guide walls co-operating with the guide rails of the switch lever end have to be resilient due to the special insertion of the slider.

SUMMARY OF THE INVENTION

It is thereby the object of the present invention to improve the slider switch in a way that the slider is reliably held in its guide during the application of any possible load and can be easily and safely mounted.

During the assembly, the slider can be inserted through the opening in the outer wall of the housing and no longer has to be locked. Thus, the guides can be designed in a way that merely the stability has to be considered. The formerly provided locking strips can be formed as broad guide strips.

An advantage of the invention is the lessening of the problem of buckling of the housing by forces acting on it via the slider is reliably avoided by the clawed holder of the wall portion. Also the arrangement of a locking member on a resilient web on the contact supporting member helps to prevent a buckling.

In a further improvement affored by the invention, stops for the spring are provided in the contact supporting member, whereby it is achieved that all parts to be defined with respect to tolerances and affecting the switching process are arranged in the contact supporting member.

BRIEF DESCRIPTION OF THE DRAWINGS

An embodiment of the invention is described below by way of the accompanying drawings, in which:

FIG. 7 is a section along line VII—VII of FIG. 2, and here too one has drawn only the contact - bridge support with the contact and two cooperating contacts; the contact spring has been drawn as by dashed lines;

FIG. 8 is a section along line VIII—VIII in FIG. 7;

FIG. 9 shows two views of the contact spring;

DETAILED DESCRIPTION

Figure 10:
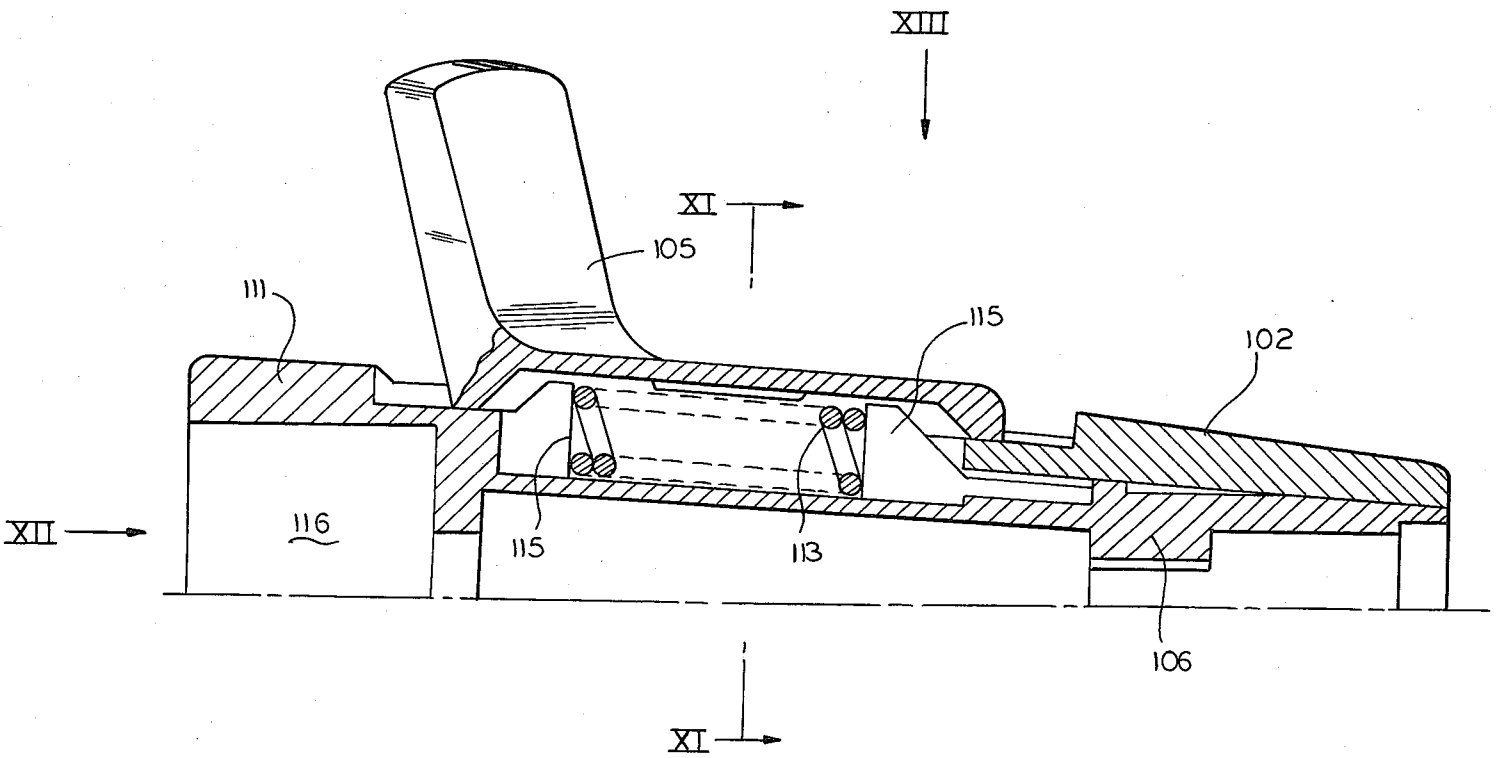
FIG. 10 is a longitudinal section through a housing with slider and indicated contact supporting member employing the present invention.
Figure 13:
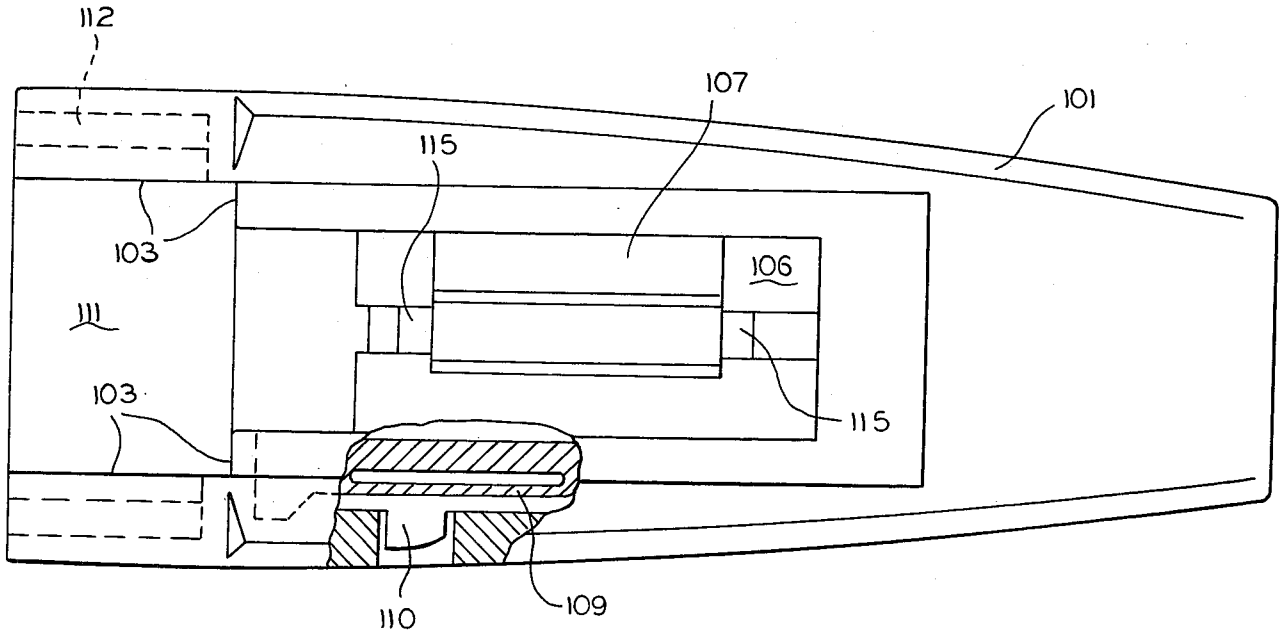
FIG. 13 is a view along line XIV according to FIG. 10.

An outer wall 102 of a housing 101 is shown in FIG. 10 with an opening 103, as shown by the cited German application as applied to the steering column of an automotive vehicle. The slider 105 is designed to be inserted into said opening 103 to be supported for slide motion via guides 104. The housing 101, furthermore, receives a contact supporting member 106 in which the slider 105, which engages a contact (not shown) secured to contact supporting member 106 by a switching finger 108 engages through a slot 107 shown best in FIG. 13. The contact supporting member 106 is held in the housing 107 via a locking member 110 injection-moulded on a resilient web 109.

Figure 12:
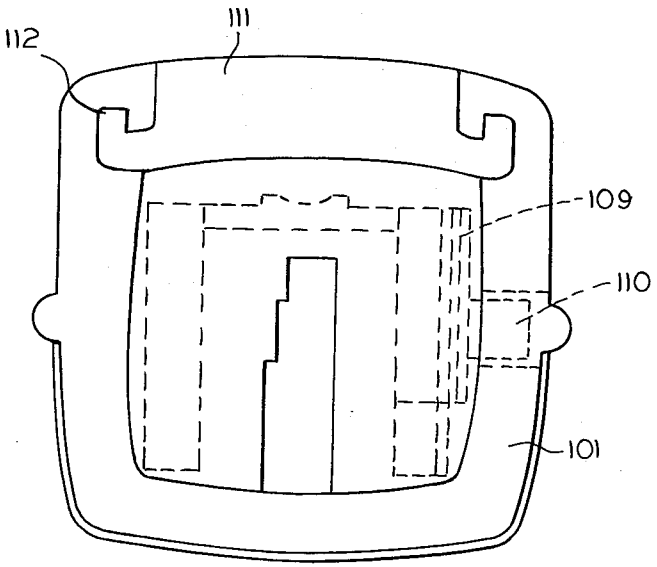
FIG. 12 is a view in direction XII according to FIG. 10.
Figure 11:
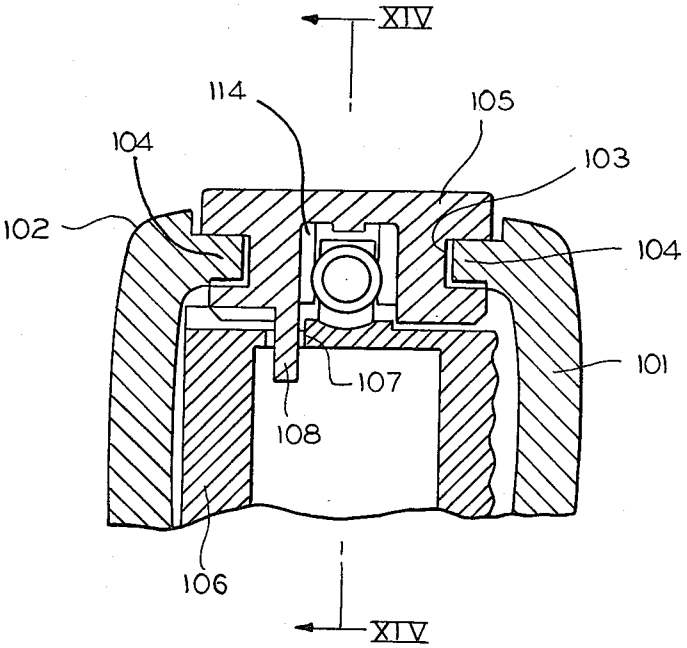
FIG. 11 is a section taken on the XI—XI of FIG. 10.

A wall portion 111 is formed on the contact supporting member 106. The wall portion 111 partially covers opening 103 and provides axial support for the slider as best seen in FIG. 10. The contour of the wall portion 111 is adapted to mate with the outer wall 102 of the housing 101 by a clawed holder 112 of FIG. 12 which rests within a mating opening of the housing wall 102. By the addition of the support produced by wall 111 the housing is protected against buckling; for this reason the slider also withstands high tear-out forces. The guide 104 (FIG. 11) can be designed in a manner which provides stability only.

A compression spring 113 (FIG. 11) is provided for the purpose of locating the slider in the centre position, and holding it there. The spring 113 is accommodated in a spring channel 114 in the slider 105 and is constrained at its axial by two upstanding stops 115 of the contact supporting member 106.

In the area 116, below wall portion 110, a push button (not shown) in the drawing is provided for the purpose of actuating a further switching device.

The described design of a slider switch makes it possible to preassembly the contact supporting member including slider 5, so that it can be locked in the housing 1 later. The slider 5 may be designed for stability and resistance to high tearing out forces. The reliability of the locking action may then be provided for in the design of the support member 106. The resulting assembly is a simple one for which design tolerances are not critical so they may be met readily and inexpensively.

The sliding switch 1 of FIGS. 1–9 is clipped into an opening 5 of a housing 6, which occurs by aid of two rest-ledges or rails 4 which were shaped into the guide walls 2 and 3 when these walls were produced (e.g. by casting). The switch 1 is guided along the lateral walls 7 and 8. This sliding switch 1 between the guide wall 2 and 3 is equipped with a groove 9 for a spring 10 with a depth which is roughly equal to half the width of the spring. The groove 9 has as boundaries on one side a supporting part 11 which is centrally located and was shaped there in the original casting or extruding, and on the other side two supporting parts 13 and 14 which are located laterally with respect to a groove extension 12. The supporting parts 13 and 14 are angularly shaped so that the spring 10 will make proper contact; together with the supporting part 11 they have approximately the same height as the lateral walls 2 and 3. The groove extension 12 engages a counterfinger 15 shaped together with the housing when this one was cast, whereas the supporting part 11 engages into a slot 16 of the housing. As the support part 11 is narrower than the spring 10, the spring 10 may, when the sliding switch 1 is caused to slide, become supported first at the edges of the housing slot and at the motion in the opposite direction at the counterfinger 15, so that the sliding switch 1 always becomes automatically pressed back into the neutral position. This neutral position is drawn in FIG. 1. The cover wall 18 of a contact supporting part 19 prevents the spring 10 from dropping out downwardly.

The contact-supporting part 19 by aid of a plunger pin 20 comes to rest in a bore 21 of the housing 6; this part 19 accommodates the contact 22 and the cooperating contacts 23 and serves as support for the contact spring 24. The cooperating contacts 23 have been rigidly attached by riveting upon the outer wall 25 of the contact-supporting part 19, whereas the contact 22 is supported so that it may rotate upon a rivet 27 which simultaneously carries upon the outside 28 of the outer wall 25 a feed contact 29. The contact 22 has been constructed as a bent lever; one lever 30 is equipped with a U-shaped guide portion 31 for the accommodation of a switching finger 32 which was created together with the guide wall 3 then when wall 3 was cast, whereas the other lever 33 has been bent around so that it will form a bevel serving as a ramp for rolling or lifting. So that the switch-finger 23 may pass through the wall cover 18 of the contact-supporting part 19, a recess 35 has been created which simultaneously serves as a stop.

The feed contact 29 also has been constructed as a bent lever, the ends 36 and 37 of which are passed through cutouts 38 at the inside 39 of the outer wall of the contact-supporting part 19. Hereby the end 37 has been bent around once more and has been soldered to a feed cable 40 whereas the other end 36 serves as a resilient (showing spring action) sliding contact for the contact 22 and in this way will compensate for the voltage loss arising across the rivet connection, should such indeed occur. The additional feed cables 41 and 42 are soldered to the cooperating contacts 23; the feed cable 43 leads to the contact spring 24. The feed cables 40 to 43 have been passed through the control lever 44 upon which the contact-supporting part 19 is locked, as by a catch.

The contact-supporting part 19 upon its frontal side 45 is equipped with a step-shaped slot 46. Into this slot has been hung a switch key 47 with the contact spring 24. The switch key 47 consists of a switch knob 48 which accommodates a compression spring 49, and a guide part 50 with an opening 51. The opening 51 has been shaped with a bevel portion 52 for the guiding of the prestressed contact spring 24. Furthermore there have been created at the guide part, when the part was produced (as by casting), right away to stop rails 53 for limiting of the switch motion of the switch key 47, and also a small stop-collar, which prevents that the contact spring 24 will become deflected upwardly (one does not see this collar as it is covered by the contact spring 24.) The stop rails 53 hit the wall portion 54 of the contact-supporting part 19. The contact spring 24 has been equipped with a notch 55 which surrounds the step-recess 56 in the frontal side of the contact-supporting part and in this way becomes retained in its position then when the switch key 47 is set, what even brings about that the prestressed contacting spring 24, as the bevel face 52 is present, may do a switching motion.

All the individual parts of the switch described in FIGS. 1–9 are kept together by a catch-lock setup, then may become dissasembled at any time. For the assembling first of all, one takes the contact-supporting part 19 and attaches to it the cooperating contacts 23, the contact 22 and the feed contact 29. Thereafter, one pushes the feed cables 40 till 43 through the housing 6, and they are soldered into the contact-supporting part 19. The switch key 47 with the contact spring 24 thereafter are hung into the step-shaped slot 46 and are locked-in together inside the housing 6 in the bore 21 under application of the plunger pin 20. As final operation one inserts the sliding switch 1, with the spring 10 located in its correct position, into the housing; the switchfinger is pushed into the U-shaped guide portion 31 of the contact 22 and under use of the rest rails 4 is locked into the housing 6.

Figure 1:
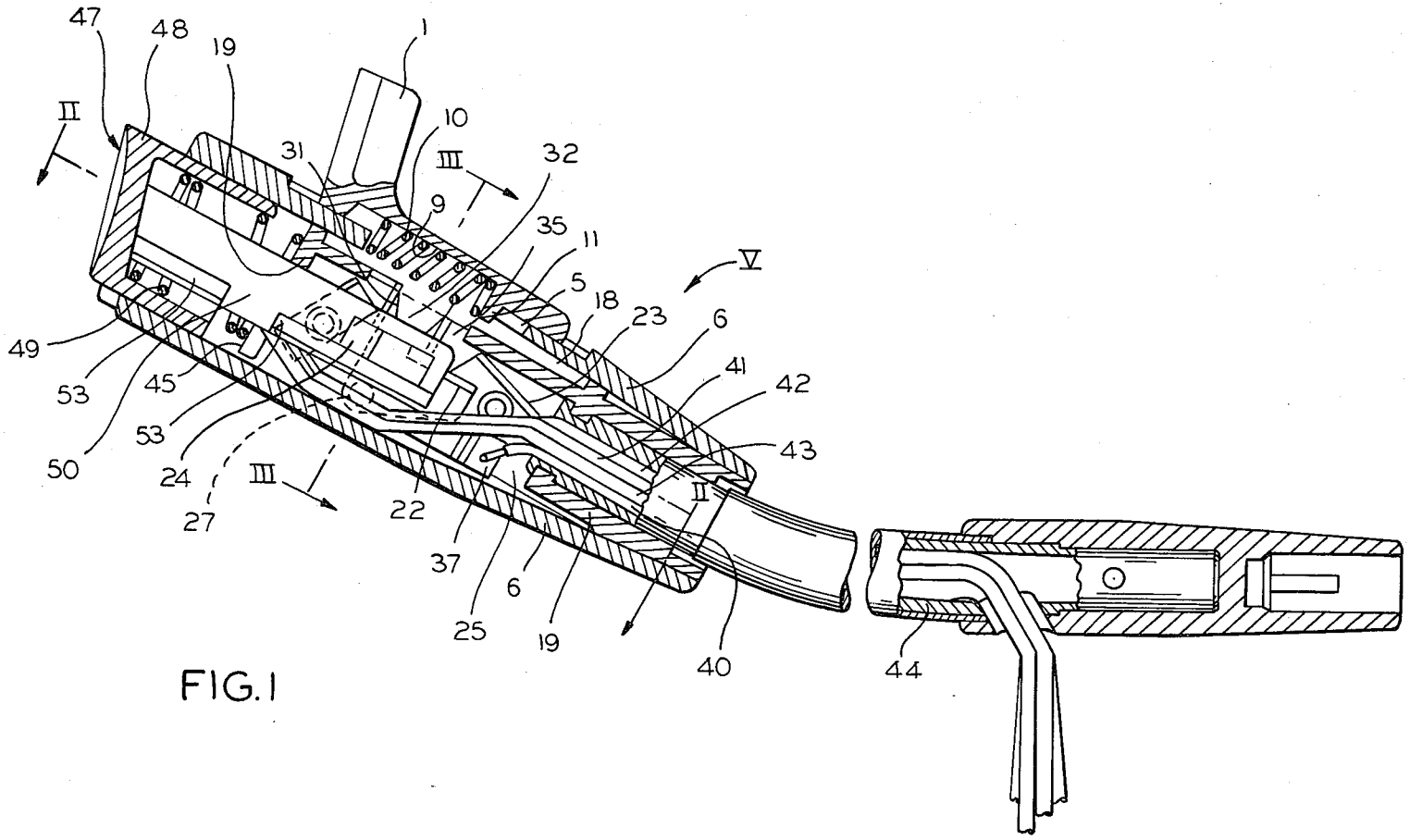
FIG. 1 shows the switch of the patent in longitudinal section as it is installed into the end of a control lever.
Figure 2:
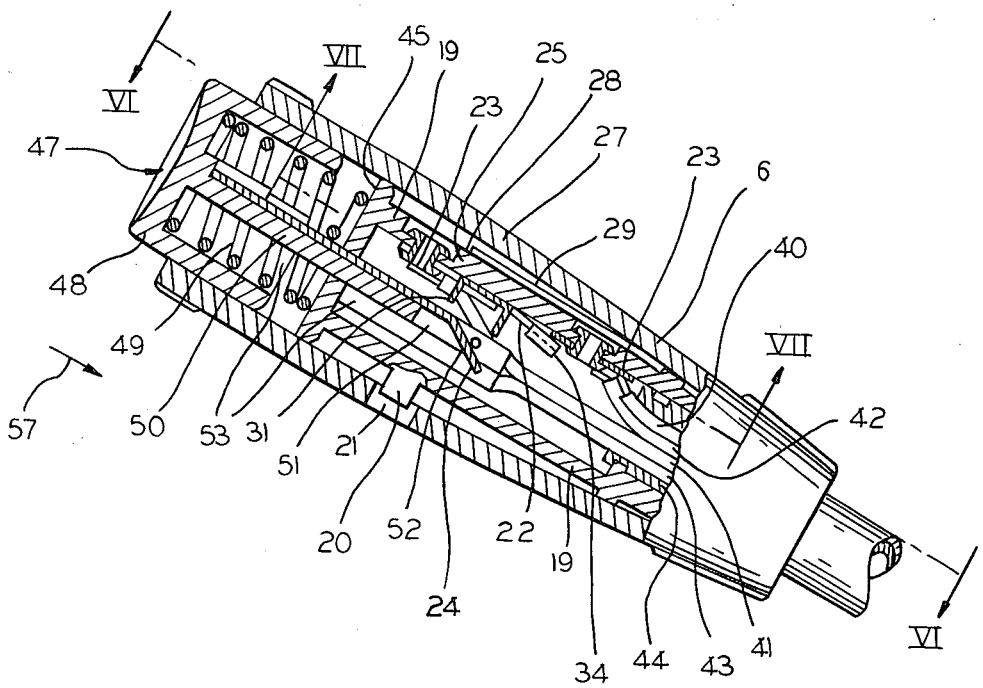
FIG. 2 is a section along line II—II of FIG. 1.
Figure 3:
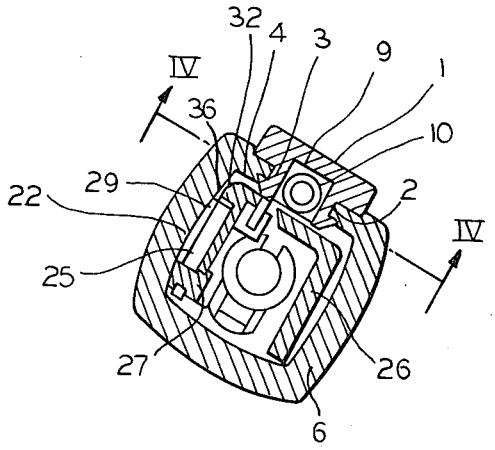
FIG. 3 is a section along line III—III in FIG. 1.
Figure 4:
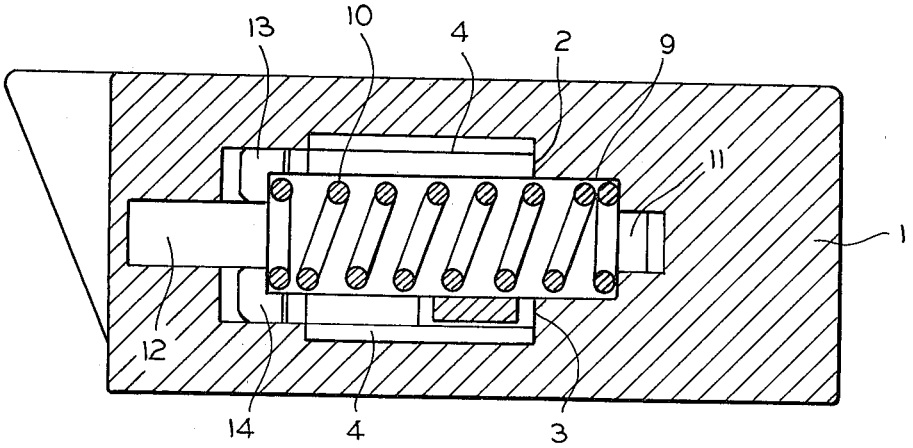
FIG. 4 is a section along line IV—IV of FIG. 3; showing the sliding switch by itself, without the housing.
Figure 5:
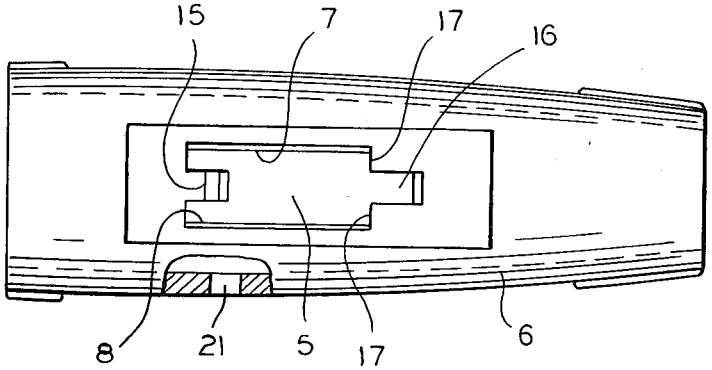
FIG. 5 is a plan of the housing, without the sliding switch.
Figure 6:
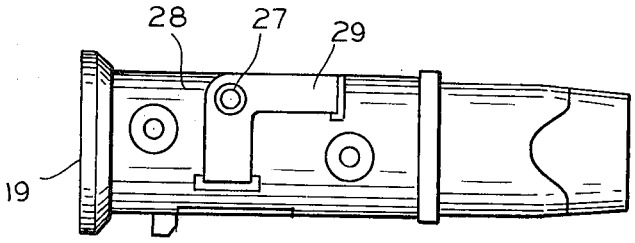
FIG. 6 is a section along line VI—VI of FIG. 2, whereby has been drawn only the contact - bridge support with the feed contact, which has been constructed as a bent lever.

The sliding switch will perform like this: In FIGS. 1 and 2 is shown the neutral position. In this positon, the contact 22 with the other lever 33 comes to rest upon the right cooperating contact 23. The contact sring 24 touches the guide part 50, and the contact 22 comes to rest upon a cooperating contact 23. Upon actuation of the switch key 47 in the direction of the arrow 57, the contact spring 24 is lifted off the guide part due to the bevel portion (inclination) 54, but the contact spring, in contrast to the switch key, remains in the axial direction and creates a touching contact with the contact 22. After release of the switch key 47, contact 22 under the action of the compression spring 49, becomes immediately returned into the neutral position which is the position shown.

When the sliding switch is pushed towards the left against the resistance of the spring 10 then an additional touching contact is established between the contact piece 22 and the left cooperating contact piece 23.

At the shifting of the sliding switch towards the right there is interrupted also the contacting between the right cooperating contact 23 and the lever 33 of the contact 22. After the releasing of the sliding switch an automatic return into the neutral position, as shown by the drawings, always occurs.

One recognizes easily, when reviewing this typical example, that by a slight change only of the contact setting and/or by a different positioning of the spring 10 one creates many different application possibilities for such a switch.

What we claim is:

1. A slider switch mechanism especially adapted to mount in a generally cylindrical tubular column such as the steering column of an automotive vehicle, said column having one axial end thereof open, said open end further extending through an inset in the sidewall of the column, said mechanism unitarily insertable into the bore of the tubular column through the open end, said mechanism including an axially elongated suport member bearing a slider member therein, said slider member positioned to rest in the insert so as to be accessible from the exterior of the column, a resilient locking member on said support member mating with a retaining wall of said column during insertion of said assembly into said column to telescopically affix said support member stationarily within said column, said slider member including a manually operable handle protruding from the body thereof through the inset of said column wall, guide means in said column wall on the sides of the inset for constraining said slider member to movement along the body of said support member and said column in a direction parallel to the column axis, a contact operating finger on said slider member movable relative to said support member responsive to slide movement of the slider member.

2. A slider switch mechanism as claimed in claim 1 in which there are clawed holders in the axial end of the support member for engaging said column wall to further affix the assembly in said column and in which there is a compression spring within said alignable cavities of both slider member and said support member, said spring bearing against both said members to allow axial movement of the slider member relative to the support member.

3. A slider switch mechanism as claimed in claim 1, in which said resilient locking member comprises a radially extending projection from a resilient rib affixed to said support, and said retaining member comprises an opening in said column wall for receiving said projection.

* * * * *